United States Patent [19]

Iwanaga

[11] Patent Number: 4,725,060

[45] Date of Patent: Feb. 16, 1988

[54] SET OF GOLF CLUBS

[75] Inventor: Takeshi Iwanaga, Kobe, Japan

[73] Assignee: Sumitomo Rubber Industries, Inc., Kobe, Japan

[21] Appl. No.: 866,709

[22] Filed: May 27, 1986

[30] Foreign Application Priority Data

May 27, 1985 [JP] Japan ..... 60-114996

[51] Int. Cl.[4] ..... A63B 53/10

[52] U.S. Cl. ..... 273/77 A; 273/80 B

[58] Field of Search ..... 273/80 B, 77 A, DIG. 7, 273/DIG. 23, 81.5, 81.6

[56] References Cited

U.S. PATENT DOCUMENTS 4,135,035 1/1979 Branen ..... 273/80 B
4,319,750 3/1982 Roy ..... 273/80 B

FOREIGN PATENT DOCUMENTS 732501 4/1966 Canada ..... 273/80 B
52-26794 7/1977 Japan ..... 273/77 A
1504446 3/1978 United Kingdom ..... 273/80 B

*Primary Examiner*—George J. Marlo
*Attorney, Agent, or Firm*—Birch, Stewart, Kolasch & Birch

[57] ABSTRACT

A set of golf clubs each having a fiber reinforced plastic shaft incorporating helically wound reinforcing filaments over the entire length thereof, the shaft comprising an intermediate flex section interposed between a head-side section and a grip-side section, a filament winding angle in the flex section being larger than that in the head-side and grip-side sections so that a maximum bendability is provided at the flex section, wherein location of the flex section gradually differs from club to club in the set in order of club number in a manner that any club of smaller number in the set has its flex section closer to its club head than any club of greater number in the set.

12 Claims, 12 Drawing Figures

SET OF GOLF CLUBS

BACKGROUND AND SUMMARY OF THE INVENTION

1. Field of the Invention

This invention relates to a set of golf clubs each designed to suit a particular swing, and more particularly to a set of golf clubs each having a fiber reinforced plastic shaft incorporating helically wound reinforcing filaments over the entire length thereof, with different shaft flex characteristics most suited to a particular shaft length.

2. Prior Art

In recent years, golf club shafts formed of fiber reinforced plastic (FRP) have increasingly replaced metallic shafts to realize weight reduction. Such FRP shafts are manufactured for example by the so-called filament winding method in which reinforcing filaments, such as glass filaments and carbon filaments, are helically wound around the shaft axis.

In most of the conventional FRP club shafts, a filament winding angle (the angle formed by the helically wound reinforcing filament and the shaft axis) is constant throughout the entire shaft length, thus failing to provide a particular flex section that is most easily bendable than any other section of the shaft.

On the other hand, in Japanese Patent Publication No. 52-26794 published July 15, 1977 (Application No. 49-29078, filed Mar. 15, 1974, Inventors: Inoue et al. ) there is proposed a particular FRP club shaft incorporating helically wound carbon filaments the winding angles of which are gradually reduced as the shaft diameter varies. However, this particular prior art does not aim to provide a flex section at a specific region within each shaft length, so that mechanical or physical properties of the club shaft gradually vary continuously axially of the shaft, which is the natural consequence of the winding variation mode.

Generally, golf clubs of smaller number having longer shafts are required to have a shaft flex point (kick point) at a location closer to the club head to ensure a greater flying distance of the hit ball, whereas golf clubs of greater number having shorter shafts are required to have a shaft flex point (kick point) at a location closer to the grip to ensure controlled swing for exact drop point of ball. However, a conventional set of golf clubs of the FRP shaft type all have similar shaft flex characteristics and hence constant kick points, consequently failing to meet the above described requirements.

It is, therefore, an object of the present invention to provide a set of FRP shaft golf clubs of different length in which each club shaft has a well defined flex section and in which all shafts are individually adjusted in kick point depending on the respective length of the shafts.

According to the present invention, there is provided a set of golf clubs each having a fiber reinforced plastic shaft incorporating helically wound reinforcing filaments over the entire length thereof, the shaft comprising an intermediate flex section interposed between a head-side section and a grip-side section, a filament winding angle in the flex section being discontinuously larger than that in the head-side and grip-side sections so that a maximum bendability is provided at the flex section, wherein location of the flex section gradually differs from club to club in the set in order of club number in the manner that any club having a smaller number in the set has its flex section closer to its club head than any club of greater number in the set.

Other objects, features and advantages of the present invention will become apparent from the following detailed description.

BRIEF DESCRIPTION OF THE DRAWINGS

In the accompanying drawings

DESCRIPTION OF THE PREFERRED EMBODIMENTS

Figure 1:
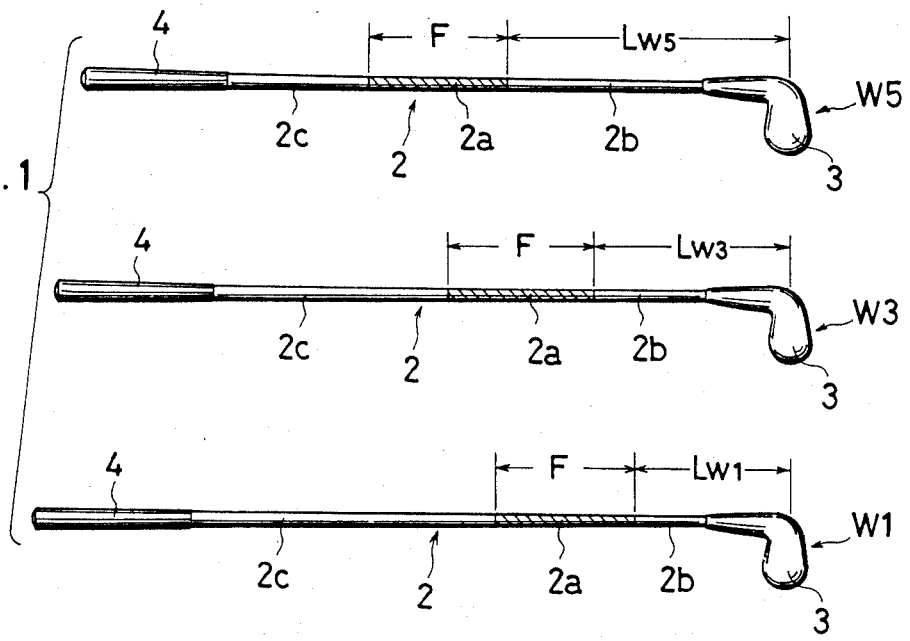
FIG. 1 is a schematic view illustrating wood golf clubs of different lengths in a set according to the present invention.

Referring now to the accompanying drawings, a set of golf clubs are illustrated in FIG. 1 as including wood clubs of different lengths which are referred to respectively as No. 1 wood W1, No. 3 wood W3 and No. 5 wood W5, but may also include additional wood clubs such as No. 4 wood. As is well known, each wood club comprises a gently tapering shaft 2 provided at its respective ends with a wood head 3 and a grip 4. The shaft 2 is made of FRP and has an intermediate flex section **2*a* positioned between stiffer head-side and grip-side sections 2*b*, 2*c***, as will be hereinafter described in detail.

Figure 2:
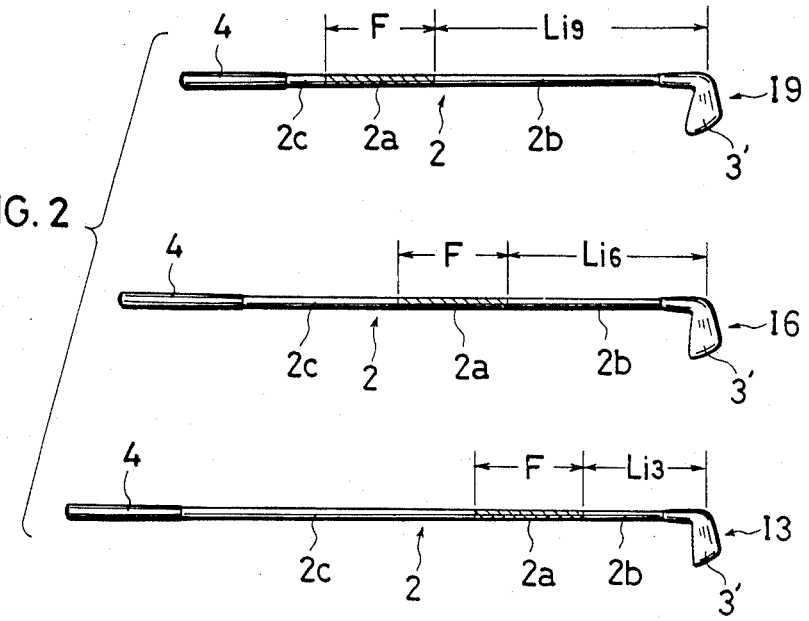
FIG. 2 is a schematic view showing iron clubs of different lengths in a set according to the present invention.

FIG. 2 illustrates another golf club set which includes iron clubs I3, I6, I9 of different lengths but may additionally include other kinds of irons such as No. 4 iron, No. 5 iron, No. 7 iron, No. 8 iron, sand wedge and putter. Each iron clubs comprises an FRP shaft 2 provided at its respective ends with an iron head 3' and a grip 4, with an intermediate flex section **2*a* located between head-side and grip-side sections 2*b*, 2*c***.

As is apparent from FIG. 1, a longer one of the wood clubs has its shaft flex section **2*a* located closer to the head 3** than a shorter one. More particularly, the following dimensional relation is established among the respective wood clubs:

$$Lw1 < Lw3 < Lw5 \quad (1)$$

where Lw1, Lw3 and Lw5 represent the distances in the respective woods from a predetermined point on the head 3 to the head-side end of the flex section **2*a***.

In the iron club set, similarly, the location of the intermediate flex section **2*a* is closer to the head 3'** with increasing shaft length. Thus, the dimensional relation among the iron clubs is represented by $$Li3 < Li6 < Li9 \quad (2)$$

where Li3, Li6 and Li9 indicate the distances in the respective irons between a center of the head 3' and the head-side end of the flex section 2a.

Figure 3:
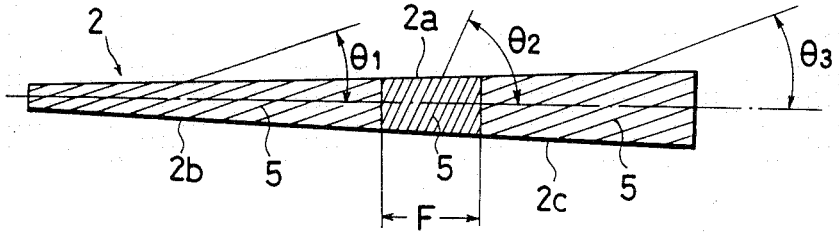
FIG. 3 is an enlarged, somewhat exaggerative view of an FRP shaft schematically illustrating a mode of filament winding according to the present invention.
Figure 12:
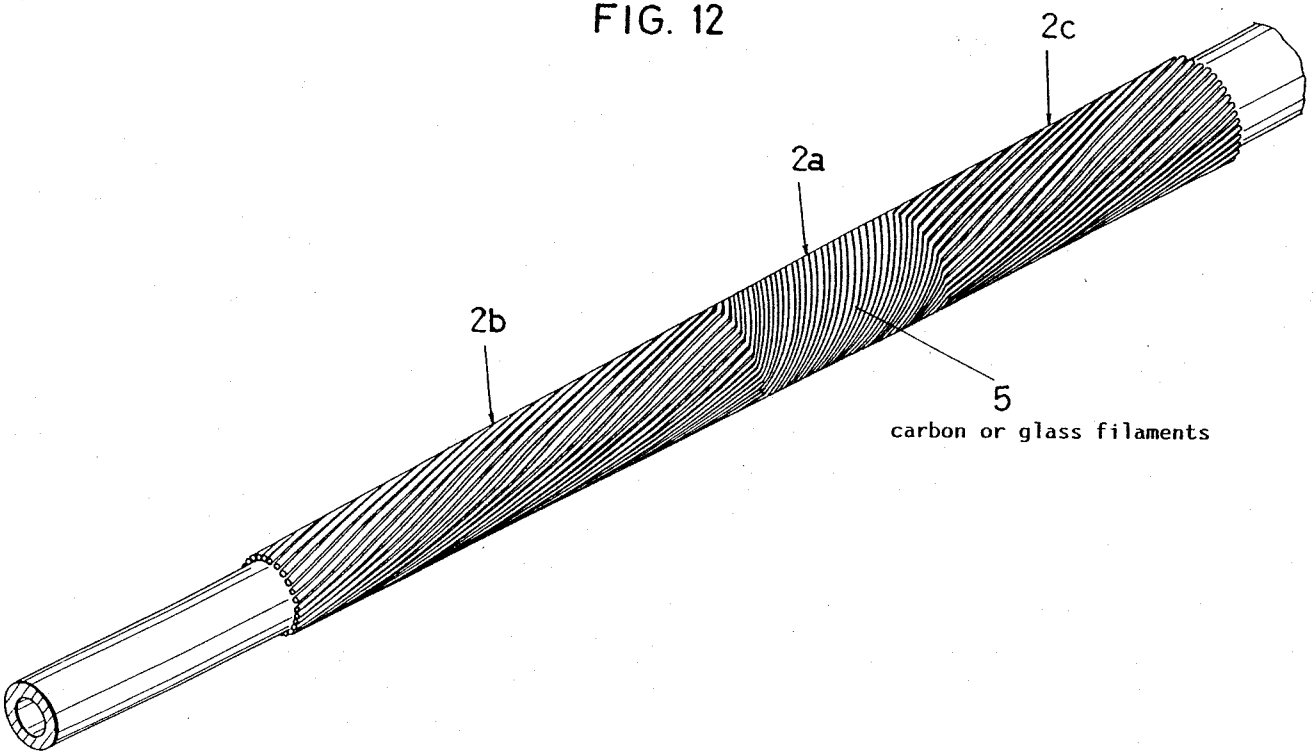
FIG. 12 is a view illustrating the windings on a shaft.

As best illustrated in FIG. 3 and in FIG. 12, each of the FRP shafts 2 of the wood clubs (FIG. 1) and the iron clubs (FIG. 2) incorporates known reinforcing filaments 5 such as carbon filaments or glass filaments, helically wound about a longitudinal axis of the shaft by the known filament winding method. While only one layer of filaments 5 (impregnated with a liquid resin for adhesion to each other and to the illustrated core or mandrel) is shown in FIG. 12, it should be understood that subsequent layers of such filaments are laid-up on the illustrated layer to provide a desired wall thickness of a club shaft. Further, filaments in two adjacent layers may be in intersecting relation.

According to the invention, a filament winding angle $\theta_2$ in the intermediate section 2a is discontinuously larger than the filament winding angles $\theta_1$, and $\theta_3$ in the head-side and grip-side sections 2b, 2c, respectively. Thus, the intermediate section 2a is a strictly defined part which exhibits a much higher flexibility than the remaining sections 2b, 2c, and which enables readier control of the shaft flex characteristics by changing the position and length of the intermediate section 2a as well as the filament winding angles within the respective shaft sections 2a, 2b, 2c.

The length F of the intermediate flex section 2a is preferably selected within a range of 4 to 30 cm, whereas the filament winding angles advantageously meet the following requirements.

$$5° \leqq (\theta_2 - \theta_1) \leqq 30° \quad (3)$$

$$5° \leqq (\theta_2 - \theta_3) \leqq 30° \quad (4)$$

Reference is now made to the specific test results which have been conducted to prove the various shaft flex characteristics achieved by the invention by using the wood and iron clubs of FIGS. 1 and 2 shown in TABLE 1 in which character L indicates the distance from the predetermined point on the club head 3 or 3' to the head-side end of the intermediate flex section 2a in each of the clubs in the set.

TABLE 1

| | Club No. | L (cm) |
|---|---|---|
| Wood | W1 | 20.1 |
| | W3 | 29.0 |
| | W4 | 33.0 |
| | W5 | 37.0 |
| Iron | I3 | 22.0 |
| | I4 | 26.0 |
| | I5 | 30.0 |
| | I6 | 34.0 |
| | I7 | 38.0 |
| | I8 | 42.0 |
| | I9 | 46.0 |

*The length F of the intermediate flex section 2a of each shaft 2 is 16 cm.
*The filament winding angles $\theta_1$, $\theta_2$ and $\theta_3$ in the respective shaft sections 2b, 2a, 2c are 15°, 25°, 15°.
*The reinforcing filaments 5 used are carbon filaments.

Figure 4:
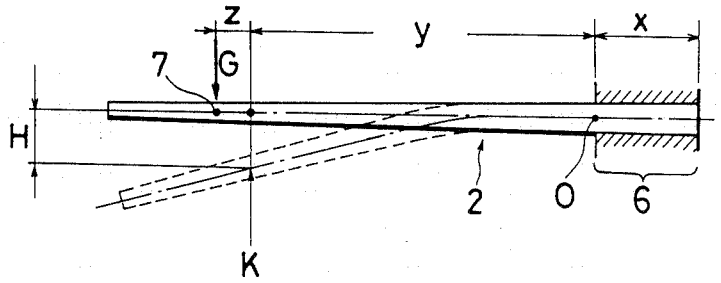
FIG. 4 is a view illustrating a normal deflection measuring method for the club shaft.

In the test illustrated in FIG. 4, the shaft 2 was secured at its larger diameter end to a fixed support 6 in a cantilever fashion, and a load G was applied downward to the smaller diameter free end thereof at a point 7 to measure the resultant deflection H at a point K. When the length of the shaft 2 was insufficient for measurement, an extension was added to the smaller diameter end of the shaft 2 to ensure that the load applying point 7 was positioned at a predetermined distance from the support 6. According to this particular example, the length x of the support 6, the interval y between the forward end O of the support 6 and the measuring point K, and the interval z between the measuring point K and the load applying point 7 were 222 mm, 678 mm and 25 mm, respectively, whereas the load G exerted was 2.7 kg.

The above described measuring method, which was applied equally to the shafts of the wood clubs as well as of the iron clubs, will be hereinafter referred to as "normal deflection measuring method" for the convenience of explanation, whereas the measurement H obtained by such a method is defined simply as "normal deflection".

Figure 5:
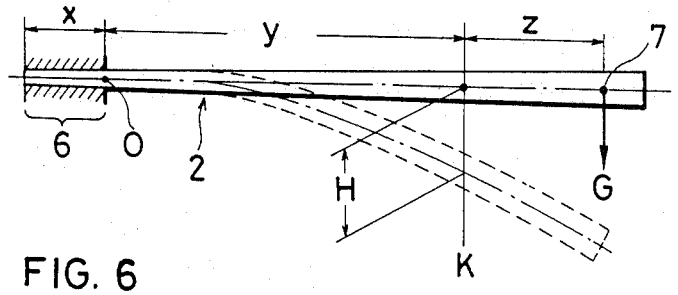
FIGS. 5 and 6 are views equally illustrating reverse deflection measuring method for the club shaft.
Figure 6:
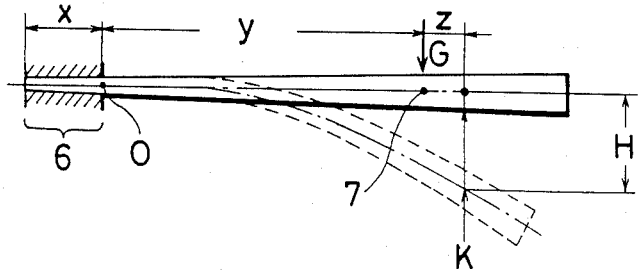

Each of FIGS. 5 and 6 shows a slightly modified measuring method in which the shaft 2 was secured at its smaller diameter end to a fixed support 6, and a load G was applied downward to the larger diameter free end thereof at a point 7 to measure the resultant deflection H at a point K. When required, an extension of an appropriate length was added to the larger diameter end of the shaft 2 to provide a specified distance between the support 6 and the load applying point 7.

Such a measuring method is hereinafter referred to as "reverse deflection measuring method", and the measurement H obtained by this method is represented as "reverse deflection".

In the example of FIG. 5, which was applied only to the shafts of the wood clubs, the length x of the support 6, the interval y between the forward end O of the support 6 and the measuring point K, the interval z between the measuring point K and the load applying point 7 were 100 mm, 670 mm and 322 mm, respectively, whereas the load G applied was 1 kg.

On the other hand, in the example of FIG. 6, which was applied only to the shafts of the iron clubs, the length x of the support 6, the interval y between the forward end O of the support 6 and the measuring point K, and the interval z between the measuring point K and the load applying point 7 were 100 mm, 645 mm and 25 mm, respectively, whereas the load G exerted was 2.7 kg.

For comparison, conventional FRP shafts for woods and iron clubs were also subjected to the normal and reverse deflection measuring methods to obtain normal and reverse deflections H. The test conditions for the conventional shafts were exactly the same as those for the shafts of the present invention, except that each of the conventional shafts made of CFRP has a constant filament winding angle of 15° throughout the entire shaft length and thus provides no flex section.

The results of the above described tests are illustrated in TABLE 2 below.

TABLE 2

(Unit: mm)

| | | Invention (Clubs of TABLE 1) | | Conventional (Winding angle Constant at 15°) | |
|---|---|---|---|---|---|
| | Club No. | Normal Deflection (H) | Reverse Deflection (H) | Normal Deflection (H) | Reverse Deflection (H) |
| Wood | W1 | 66.0 | 57.5 | 66.0 | 50.0 |
| | W3 | 67.0 | 54.5 | 66.0 | 49.0 |
| | W4 | 67.5 | 53.5 | 66.0 | 48.5 |

TABLE 2-continued (Unit: mm)

| | Club No. | Invention (Clubs of TABLE 1) Normal Deflection (H) | Invention (Clubs of TABLE 1) Reverse Deflection (H) | Conventional (Winding angle Constant at 15°) Normal Deflection (H) | Conventional (Winding angle Constant at 15°) Reverse Deflection (H) |
|---|---|---|---|---|---|
| | W5 | 68.0 | 52.5 | 66.0 | 48.0 |
| Iron | I3 | 60.0 | 58.0 | 57.0 | 52.5 |
| | I4 | 61.5 | 56.0 | 57.0 | 51.5 |
| | I5 | 63.0 | 54.0 | 57.0 | 50.5 |
| | I6 | 64.5 | 52.0 | 57.0 | 49.5 |
| | I7 | 66.0 | 51.0 | 57.0 | 48.5 |
| | I8 | 68.0 | 50.0 | 57.0 | 47.5 |
| | I9 | 74.0 | 49.0 | 57.0 | 47.0 |

As is clear from TABLE 2, the normal deflection H of the shafts for the wood and iron clubs according to the invention increases with decreasing shaft length, whereas the reverse deflection H decreases as the shaft length reduces. In contrast thereto, the normal deflection H of the shafts for the conventional wood and iron clubs remains constant despite changes in the shaft length, while the reverse deflection H slightly reduces with decreasing shaft length at a much lower rate than in the clubs of the invention.

These results indicate that, in the clubs of the invention, the shorter of the shafts is more flexible on the grip side than on the head side to provide a higher kick point, consequently ensuring controlled swing for exact drop point of ball. Conversely, the longer of the shafts is more flexible on the head side than on the grip side to give a lower kick point required for a longer flying distance of a hit ball.

Figure 7:
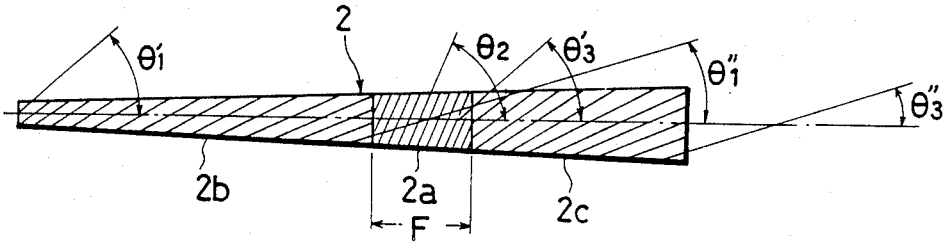
FIGS. 7 through 9 are views illustrating modified modes of filament winding according to the present invention.

As illustrated in FIG. 7, the filament winding angle in the head-side section 2b as well as in the grip-side section 2c may vary continuously axially of the shaft 2. More particularly, the winding angle within the head-side section 2b increases progressively toward the head end thereof, whereby the winding angle $\theta'_1$ at the head end is larger than the winding angle $\theta_1''$ at the other end of the head-side section 2b. Similarly, the winding angle within the grip-side section 2c decreases gradually toward the grip end thereof, so that the winding angle $\theta_3''$ at the grip end is smaller than the winding angle $\theta_3''$ at the other end of the grip-side section 2c. It is of course possible to so set the axial winding variations in the head-side and grip-side sections 2b, 2c that the angles $\theta''_1$, $\theta''_3$ are equal to or larger than the angles $\theta'_1$, $\theta'_3$, respectively.

Figure 8:
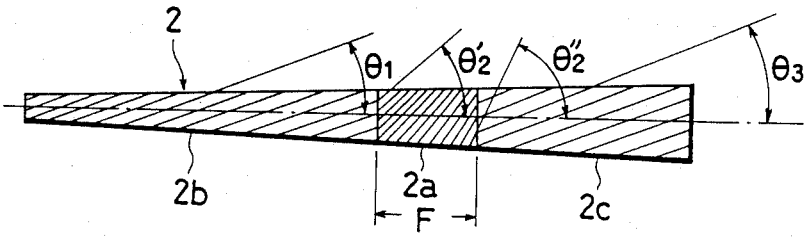

The filament winding angle in the intermediate flex section 2a, which is illustrated as constant in the examples of FIGS. 3 and 7, may also change continuously axially of the shaft 2, as shown in FIG. 8.

According to the illustrated example, the winding angle $\theta'_2$ at one end of the flex section 2a close to the grip-side section 2c is larger than the winding angle $\theta''_2$ at the other end thereof, but the reverse relation is naturally possible.

In the examples of FIGS. 7 and 8, the average filament winding angles in the respective sections 2a, 2b, 2c of the shaft 2 should preferably meet the requirements defined in the formulas (3) and (4) given in connection with the example of FIG. 3.

Figure 9:
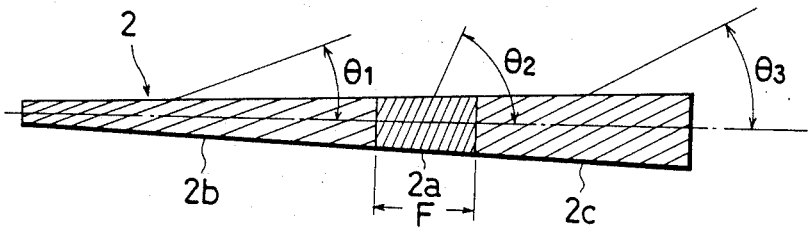

FIG. 9 shows another example of the FRP shaft, according to which the filament winding angle $\theta_3$ in the grip-side section 2c is larger than the filament winding angle $\theta_1$ in the head-side section 2b. Alternatively, the angle $\theta_1$ may be larger than the angle $\theta_3$. It is appreciated in this example that the filament winding angle in each of the shaft sections 2a, 2b, 2c is constant axially of the shaft 2.

Figure 10:
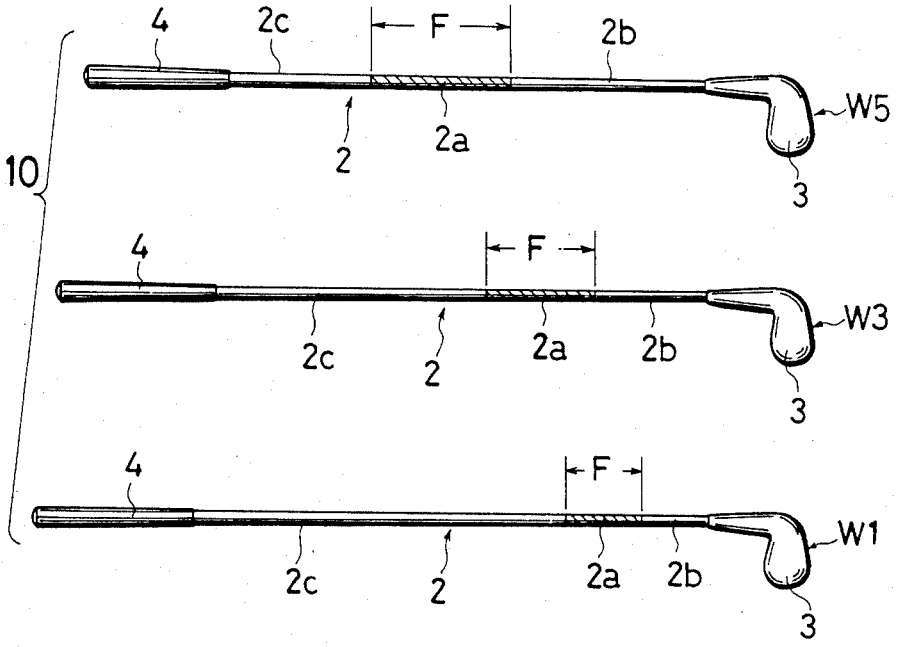
FIG. 10 is a schematic view illustrating a modification of wood clubs in a set embodying the present invention.
Figure 11:
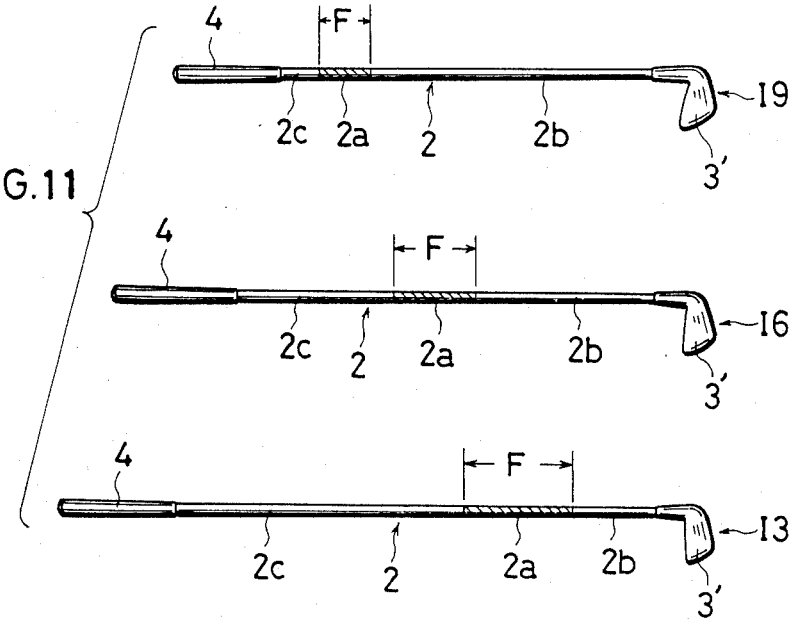
FIG. 11 is a schematic view representing modification of iron clubs in a set embodying the present invention.

In particular embodiments as illustrated in FIGS. 10 and 11, the shafts 2 of the wood clubs W1, W3, W5 and iron clubs I3, I6, I9, respectively have intermediate flex sections 2a of different lengths. In the example of FIG. 10, the length F of the flex section 2a increases with decreasing shaft length.

In the example of FIG. 11, the length F of the flex section 2a increases with increasing shaft length.

The invention being thus described, it will be obvious that the same may be varied in many ways. For example, the head 3 of the wood club may be made of metal instead of wood, and the tapering angle of the shaft 2 can be optionally selected within an acceptable range. Such variations are not to be regarded as a departure from the spirit and scope of the invention, and all such modifications as would be obvious to those skilled in the art are intended to be included within the scope of the appended claims.

I claim:

1. A set of golf clubs each having a fiber reinforced plastic shaft incorporating helically wound reinforcing filaments over the entire length thereof, wherein:

each shaft comprises an intermediate flex section interposed between and bounded by a head-side section and a grip-side section, the helically wound filaments vary abruptly in winding angle at each of the boundaries between said three sections of the shaft so that the filament winding angle in said flex section is larger by 5° to 30° than that in each of said head-side and grip-side sections to provide a maximum bendability of said flex section, and the location of said flex section gradually differs from club to club in the set in order of club number in a manner such that any club of smaller number in the set has its flex section closer to its club head than any club of greater number in the set.

2. The set of golf clubs as defined in claim 1, wherein said flex section has a length of 4 to 30 cm.

3. The set of golf clubs as defined in claim 1, wherein said golf clubs have an equal length of said flex section.

4. The set of golf clubs as defined in claim 1, wherein the flex sections of the respective clubs in the set differ in length from each other.

5. The set of golf clubs as defined in claim 1, wherein said filament winding angle in said head-side section gradually varies continuously axially of said shaft.

6. The set of golf clubs as defined in claim 1, wherein said filament winding angle in said grip-side section gradually varies continuously axially of said shaft.

7. The set of golf clubs as defined in claim 1, wherein said filament winding angle in said flex section gradually varies continuously axially of said shaft.

8. The set of golf clubs as defined in claim 1, wherein the filament winding angle in said head-side section differs from that in said grip-side section.

9. The set of golf clubs as defined in claim 1, wherein the filament winding angle in said head-side section is substantially equal to that in said grip-side section.

10. The set of golf clubs as defined in claim 1, wherein the filament winding angle in said flex section is substantially constant.

11. The set of golf clubs as defined in claim 1, wherein said filaments are carbon filaments.

12. The golf club set according to claim 1, wherein said filaments are glass filament.

* * * * *